United States Patent [19]

Chen et al.

[11] 4,146,958

[45] Apr. 3, 1979

[54] SAFETY RAZOR

[75] Inventors: Evan N. Chen; Edward A. Beddall, both of Fairfield; Bryan J. Goddard, North Branford, all of Conn.

[73] Assignee: Warner-Lambert Company, Morris Plains, N.J.

[21] Appl. No.: 732,567

[22] Filed: Oct. 15, 1976

[51] Int. Cl.[2] ..... B26B 21/14; B26B 21/22

[52] U.S. Cl. ..... 30/47; 30/50

[58] Field of Search ..... 30/47, 50, 77, 81, 82

[56] References Cited

U.S. PATENT DOCUMENTS

| | | | |
|---|---|---|---|
| 983,639 | 2/1911 | Ocumpaugh | 30/50 X |
| 2,044,698 | 6/1936 | John | 30/50 |
| 2,070,028 | 2/1937 | Samuel | 30/77 |
| 3,736,563 | 1/1974 | Dorion | 30/50 |
| 3,863,340 | 2/1975 | Perry | 30/50 X |

FOREIGN PATENT DOCUMENTS

| | | | |
|---|---|---|---|
| 2332333 | 3/1974 | Fed. Rep. of Germany | 30/47 |
| 974180 | 9/1950 | France | 30/50 |
| 1433594 | 4/1976 | United Kingdom | 30/47 |

*Primary Examiner*—Gary L. Smith

*Attorney, Agent, or Firm*—Albert H. Graddis; Jeremiah J. Duggan; Stephen A. Schneeberger

[57] ABSTRACT

A safety razor contains a blade cartridge in which two blades are rigidly secured. The cartridge has a seat member with an integral blade edge guard disposed transversely along its forward margin. A first razor blade is disposed on a planar surface of the seat member and has its cutting edge located rearwardly of the guard. A second razor blade having a cutting edge located parallel to and rearwardly of the first blade edge is in contact with a mating surface of a cap member. The cap member is secured to the seat member thereby clamping the blades in desired position. The blades are maintained at a predetermined distance apart by spacing means and the guard member has a plurality of projecting teeth transversely arrayed across the guard member forming a comb guard.

14 Claims, 6 Drawing Figures

SAFETY RAZOR

BACKGROUND OF THE INVENTION

The present invention relates to safety razors of the type having a plurality of razor blades contained in a unitary cartridge assembly. More particularly, the present invention relates to a razor blade cartridge unit which has desirable shaving characteristics.

Disposable tandem blade razor blade cartridges are disclosed in various prior art references, for example, U.S. Pat. Nos. 3,934,339 and 3,890,704. These references show razor blade cartridges having twin blades with a spacer therebetween to maintain desired geometrical relationships when affixed between cap and seat members. The same references disclose inwardly directed coupling channels along the bottom portion of the seat member to facilitate placement on and attachment to complementary coupling structures on a razor handle.

Another prior art patent, viz., Pat. No. 3,660,893, demonstrates a tandem blade cartridge configuration in which the desired geometrical configuration is retained by placing the blades in tension when mounted in a combination cap and guard frame. This configuration eliminates the need for a spacer member, but does introduce problems associated with movement of the unsupported blade edges, blade processing and unit assembly. A potential advantage of this configuration rests in the feature that shaving debris can pass without obstruction between the cutting edges and out of the cartridge assembly. It also results in a potential cost saving due to the elimination of the spacer member.

United States Patent Application Ser. No. 604,505 filed Aug. 13, 1975, Inventors: Chen and Beddall now U.S. Pat. No. 4,016,648 discloses a design in which the spacer member is eliminated and debris cleared. This unit incorporates alternately spaced inwardly directed depending structures from the cap and seat members. When these are in registration with respective holes or apertures in the blades, there results clamping of the blade assembly without the normal structural obstruction.

Prior art tandem blade cartridge have achieved satisfactory shaving results and provide adequate closeness and comfort for most of the shaving public. However, with those classes of shavers presenting peculiar problems, for example, women shaving underarms and legs and those having uncommonly sensitive skin, it has been found that a different and more suitable geometrical configuration and cartridge design are desirable. In considering this design, certain parameters are controlled to provide desirable shaving characteristics. The principal of these are: tangent angle—the angle formed by a plane tangent to the blade tip and the guard bar and a plane bisecting the edge apex; exposure—the normal distance the blade edge is above (positive) or below (negative) a plane tangent to both the guard and cap members; and spans—the distance between the first blade edge apex and the guard bar and the second blade edge apex and the first apex, respectively. With proper selection of these parameters and the use of a novel guard bar structure, closeness with safety and comfort can be achieved. It is, therefore, an object of the present invention to produce a unitary disposable twin blade cartridge having improved shaving characteristics. It is another object of the invention to provide a cartridge offering increased comfort to the user while meeting normal closeness requirements. Another object of the invention is to provide a cartridge whereby the user can maintain the desired degree of comfort and closeness by controlled use of the safety razor. Yet another object of the invention is to provide an improved twin blade shaving cartridge.

SUMMARY OF THE INVENTION

In satisfaction of the foregoing objects and in overcoming problems associated with prior art shaving systems, the present invention contemplates a razor blade cartridge comprising a seat member having an integral blade edge guard transversely disposed along a forward margin thereof. A first razor blade is disposed on a planar surface of the seat member and has its cutting edge located rearwardly of the guard. A second razor blade has a cutting edge located parallel to and rearwardly of the first blade edge and is in contact with the surface of a cap member. The cap member is affixed to the seat member and clamps the blades in desired geometrical position. The guard member has a plurality of transversely arrayed forwardly projecting teeth which form a comb guard. Associated with the cartridge is means for maintaining the cutting edges a predetermined distance apart. The blades are positioned to have a tangent angle selected between 20 and 30 degrees and a negative exposure.

Another aspect of the present invention contemplates a twin blade shaving cartridge in which the first blade cutting edge has a tangent angle between 20 and 30 degrees, an exposure of approximately between −0.001 and −0.005 inch and a span of approximately 0.040 to 0.065 inch, and the second blade cutting edge has a tangent angle between approximately 20 degrees and 30 degrees, an exposure of approximately −0.004 to −0.008 inch and a span of approximately 0.040 to 0.065 inch.

In another aspect of this invention, the means for spacing the blades a predetermined distance apart comprises a blade being formed to place the second cutting edge parallel to and rearwardly of the first cutting edge.

Conventional drawing symbols are used throughout the figures and the same number represents the same or similar part in the different views. The drawings, taken in combination with the description of the invention hereafter presented, are intended as illustrative of applicants' invention and not delimiting of its scope.

DESCRIPTION OF THE PREFERRED EMBODIMENTS

Figure 1:
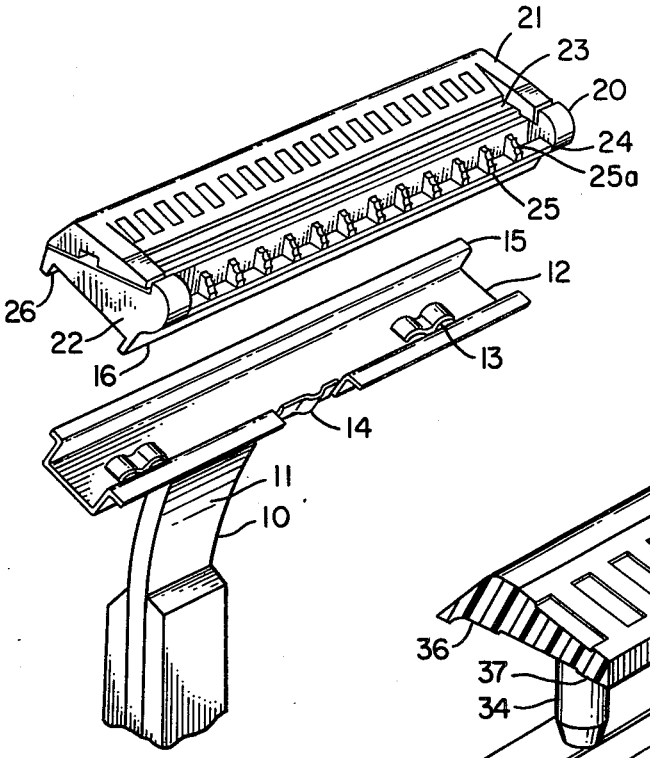
FIG. 1 is a partial exploded perspective view of a razor blade cartridge and handle employing applicants' invention.

FIG. 1 shows a razor handle 10 having a shank 11 which is connected to a coupling structure 12. Coupling structure 12 is a U-shaped channel having upper depending flanges 15. Depending flanges 15 are normal to the upstanding walls of channel 12 and mate with complementary coupling grooves on cartridge 20. Channel 12 is affixed to shank 11 by protuberances which project through complementary holes in channel 12 and are thereafter swaged over to form a permanent rigid connection. Blades 23 and 24 are clamped in a desired geometrical configuration between cap member 21 and seat member 22. An integral transversely arrayed guard member 25 is disposed along the forward margin of seat member 22 and in front of blade 24. A plurality of teeth project upwardly from guard member 25 and are equally transversely spaced across its length. Webs 16 form the interconnecting surfaces of guard bar 25 joining the roots of teeth 25*a* thereby forming a comb guard bar structure. Grooves 26 disposed transversely and parallel along the bottom surface of seat member 22 form the coupling channels for mating with razor handle coupling structure 12.

Figure 2:
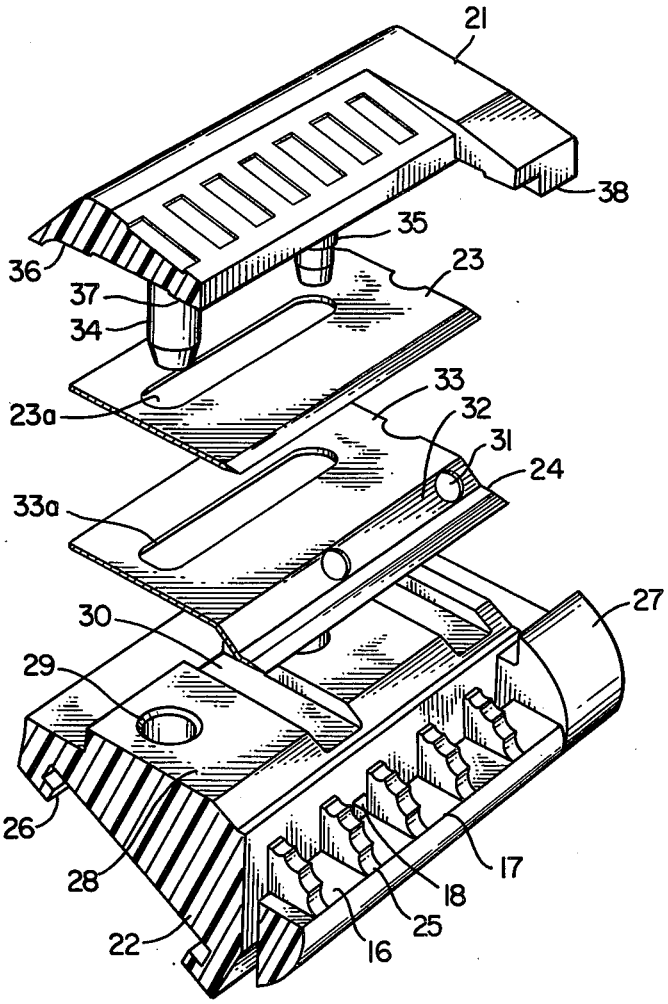
FIG. 2 is a cross-sectional exploded perspective view of the cartridge of FIG. 1.

Referring to FIG. 2, there is demonstrated in detail the novel structure of cartridge 20. Blade 24 is affixed to the upper surface of seat member 22 and may be fabricated from standard blade stock approximately 0.1787 inch in width and approximately 0.004 inch in thickness. In order to achieve the desired spacing between blade 23 and blade 24, blade body 23 is bent along a transverse line at an angle of approximately 30 degrees forming a ramp surface 32. Ramp surface 32 is then inversely bent at another 30 degree angle along a second transverse parallel line thereby causing the edge to be parallel with blade body 33.

Blade 24 is on seat member 22, and is supported by upper surface 28. Channels 30, which pass from front to back of surface 28, provide, when placed in registration with holes 31 which are formed in ramp surface 32, through-passages for shaving debris. Perforations 33*a* are located in registration with holes 29 which are spaced along the transverse length of seat 22. Second or cap blade 23 is placed on blade body 33 having the cutting edge parallel to but located rearwardly of that of blade 24. Perforations 23*a* in the body of blade edge 23 are placed in registration with those in blade body 33.

The bent blade conformation may be formed by suitable die arrangements well known to those of skill in the art and may be accomplished during the cartridge assembly operation. Of course, this same bent blade tandem assembly may be used in other types of cartridges as well as injector-type razors, e.g., the type disclosed in U.S. Pat. No. 3,858,315. When so utilized, a separate welded blade assembly is fabricated for later use in a razor. It is further noted that either the seat or cap blade may be appropriately bent to obtain the necessary spacing. In one embodiment the seat blade is bent at an angle of 30 degrees so as to place the cutting edge of the seat blade approximately 0.056 inch forwardly of the cap blade edge and approximately 0.024 inch normal distance from edge apex to edge apex. Of course, the ramp or bent portion of the blade is perforated prior to bending and the blades are welded together after bending. It is important to note that the plane of the cutting edge may be controllably bent to assume any desired angle with respect to the plane of the other blade cutting edge.

Referring again to cartridge 20, cap member 21 is affixed to blade seat 22 by a plurality of depending posts, typically posts 34 and 35, which are passed through the blade apertures into holes 29 of blade seat 22. The ends of posts 34 and 35 protrude beyond blade seat 22 and are upset or coldheaded to form a permanent unitary structural cartridge member 20. As indicated in U.S. Pat. No. 3,890,704, which is incorporated herein by reference, the relative diametrical dimensions of post 35 and the blade apertures in registration therewith are selected to provide predetermined interference fits. These fits ultimately determine the position of the blade bodies in the cartridge and hence locate the edges of blades 23 and 24. Other means which may be employed to locate the blade edges are stops on cap 21 and blade seat member 22. When employing the latter design subsequent to assembly but prior to coldheading or upsetting of posts 34 and 35, the blades are moved forwardly into the stops from the rear of the cartridge.

Integral with and arrayed transversely along the forward margin of seat member 22 is guard member 25. At the end of each guard member are abutment members 27 which mask the ends of cutting edges 23 nd 24 from coming in contact with the user. Between these abutments are arrayed a plurality of teeth members 25*a* having a predetermined minimum height Y above the plane of webs 16. Teeth 25*a* are of substantially arcuate shape smoothly transitioning into the generally arcuate shape of the lower cylindrical portion 17. The guard bar 25 is joined to the main body of seat member 22 by end abutments 27 and by a plurality of struts 18 extending to seat member 22 from the rear surface of the cylindrical portion 17.

Figure 3:
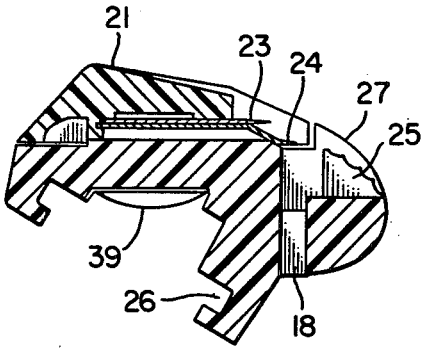
FIG. 3 is a plan cross-sectional view of the cartridge of FIG. 1.

Reference to FIG. 3, a cross-sectional view of this structure, may clarify the details of the assembly and the guard 25 structure. It shows the conformation of blade 24 and the affixing of seat member 22 to cap member 21 by the upsetting of posts 34 and 35 as indicated by rivet head 39. Abutments 27 mask the ends of the cutting edges, and guard member 25 is disposed parallel to and forwardly of the cutting edge of blade 24. Complementary coupling grooves 26 obviously slidingly couple to flanges 15.

Referring to U-channel 12 of FIG. 1, there is shown latch member 14; this latch member forms a detent with a complementary identation centrally located of the channel 26. Upon reaching correct position of cartridge 21 on channel 12, latch 14 falls into the indent acting to retain the cartridge in the desired position.

Figure 4:
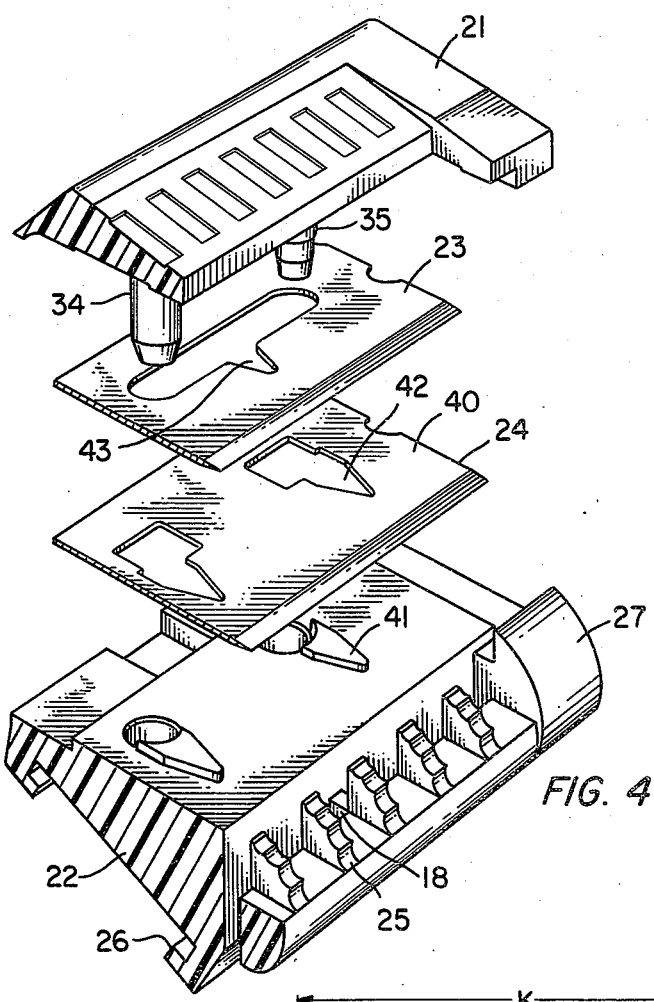
FIG. 4 is a cross-sectional exploded perspective view of another embodiment of the cartridge of FIG. 1.

Referring to FIG. 4, there is shown another embodiment of applicants' invention. Cartridge 20 employs a spacerless design, i.e., the means for spacing blades 23 and 24 a desired predetermined distance apart is, as described in United States Application Ser. No. 604,505 filed Aug. 13, 1975, now U.S. Pat. No. 4,016,648 supra, provided by alternately spaced depending land members 41 projecting upwardly from seat member 22 and downwardly from cap member 21. The seat lands 41 are in registration with complementary holes in blade member 24 passing therethrough and coming into clamping contact with blade member 23 while corresponding lands on the lower surface of cap member 21 are in registration with and pass through complementary holes in blade member 23, thereby coming in contact with and clamping blade member 24 to the upper surface 28 of seat member 22. In this design, clear passage is provided through the razor cartridge 20 for shaving debris.

Figure 5:
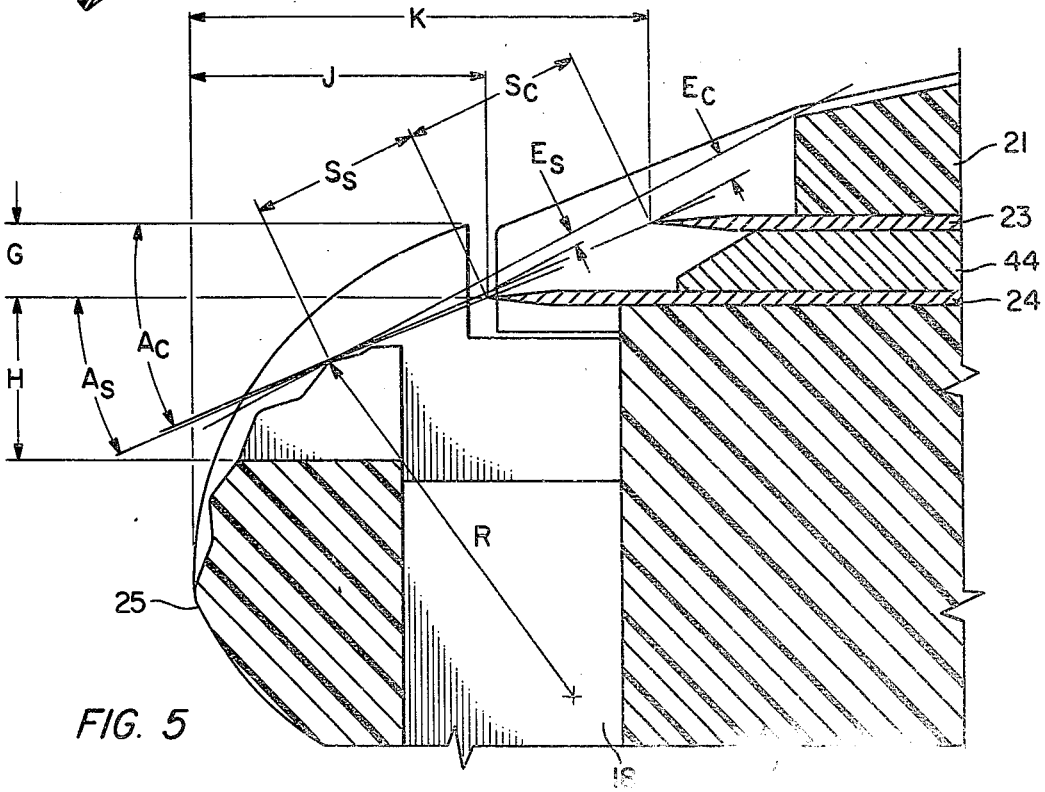
FIG. 5 is a cross-sectional plan view of another embodiment of the cartridge of FIG. 1 showing control dimensions and angles.

In FIG. 5, there is shown an embodiment of the invention employing a cartridge construction similar to that disclosed in U.S. Pat. No. 3,890,704. This embodiment is similar in all aspects to those of FIGS. 2 and 4 with the sole exception that a spacer member 44 is employed to separate the blades a predetermined distance and thereby achieve the desired geometrical configuration. Typical angles and dimensions which may be employed in applicants' invention are disclosed. $A_S$, the tangent angle of seat blade 24, is shown as formed by a plane passing through the bisector of the blade cutting edge and a plane containing the same edge and tangent to a point on guard member 25. Angle $A_C$ is the tangent angle of the cap blade 23 and similarly is formed by a bisecting plane and a plane containing cutting edge 23 and tangent to the same guard member 25. The exposure of seat blade 24 $E_S$ and cap blade 23 $E_C$ is determined by the normal or perpendicular distance from the respective edges of the blades to a plane tangent to both cap member 21 and guard member 25. The span $S_S$ of the seat blade and the span $S_C$ of the cap blade are respectively shown as the distance between the edge of blade seat 24 and the tangent point on guard bar 25 of a plane containing that same edge, while $S_C$ is the distance between the edge of seat blade 24 and cap blade 23 taken on a plane containing both edges.

Before setting out the preferred values of these parameters, it may be well to review the principles of the invention. The goal is to achieve a safe, comfortable, but close shave utilizing the features of a tandem blade cartridge design. It is recognized that a comfortable and safe shave may be achieved by the use of relatively low blade tangent angles and negative exposures. By this is meant that the cutting edges of blades 23 and 24 may fall below that imaginary plane passing tangent to both guard bar 25 and cap blade 21. For the skin of the shaver to come in contact with the cutting edge, thereby creating a potential for irritation, it is necessary that the user apply sufficient force so that the skin protrudes beyond that imaginary plane and bellies into contact with the blades. Hence, in normal use, a cartridge having negatively exposed blades will produce a comfortable but not a close shave.

To overcome this while still retaining safety, applicants have employed a comb guard bar which allows a cross-axis protrusion of the skin toward closer contact with the cutting edges. In prior art shaving devices, the skin protrudes toward the edges in a direction normal to the forward margin of the cartridge. In applicants' design, the skin is allowed to protrude minimally in that direction but also protrudes in a cross-axis or a direction parallel to the forward margin of the cartridge thus allowing the hair but not the skin to contact the blade edges. This permits a close and controlled shaving experience while still providing the safety engendered by negative edge exposures.

Figure 6:
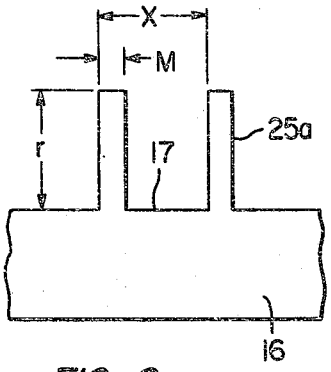
FIG. 6 is an enlarged front elevational view of the guard bar of the cartridge of FIG. 1.

Referring to FIG. 6, an enlarged fragmentary front elevational view of the comb guard bar 25 is shown. A plurality of teeth 25*a* project above the surface of web 16 a distance Y. The pitch X of teeth 25*a*, the width M and the projection distance Y are selected to allow the desired cross-axis skin protrudance without sacrificing safety or comfort. The minimum projection height Y compatible with these requirements is found to be 0.020 inch while the preferred dimension is 0.041 inch. Preferably the pitch or spacing distance X is 0.100 inch but may be varied substantially from approximately 0.050 inch to approximately 0.125 inch. The tooth width dimension M is preferably selected at 0.040 inch but may be decreased to a minimum of 0.020 inch or increased to a maximum of one-half the pitch dimension. Returning to FIG. 5, the preferred values suitable for use with guard bar 25 are: $A_S$ between approximately 20 degrees and 30 degrees but preferably selected to be 24.07 degrees, $A_C$ between approximately 20 degrees and 30 degrees but preferably at 23.61 degrees, $E_S$ at $-0.003$ inch $\pm 0.002$ inch, $E_C$ at $-0.006$ inch $\pm 0.002$ inch, $S_S$ at 0.060 inch $\pm 0.010$ inch, and, lastly, $S_C$ at approximately 0.060 inch $\pm 0.010$ inch. The preferred angle of the first blade to a tangent point on the web is approximately 32 degrees and the second blade web tangent angle is approximately 29 degrees.

Other dimensions pertinent to the cartridge are: G, the normal spacing between the blades, 0.024 inch; H, the normal spacing between the bisector plane of the seat blade 24 and web 16, 0.060 inch; J, the distance between the edge of blade 24 and a normal plane containing the extreme margin of guard bar 25, approximately 0.010 inch; R, the radius of teeth 25*a*, approximately 0.075 inch.

A cartridge fabricated in accordance with the stated dimensions and values meets the shaving goals heretofore set out. It provides a safe and close shaving experience for those classes of users who previously suffered skin irritation or inversely poor shaving results.

What is claimed is:

1. A razor blade cartridge comprising:

a seat member having an integral blade edge guard disposed transversely of and parallel to a forward margin of the seat member, the guard having a plurality of forwardly projecting teeth forming a comb guard;

a first razor blade disposed on a substantially planar surface of the seat member having a cutting edge parallel to the forward margin and located rearwardly of the guard;

a second razor blade having a cutting edge located parallel to and rearwardly of the first blade edge;

a cap member having a bearing surface in contact with the second blade and affixed to the seat member for clamping the first and second blades in desired position;

means for maintaining the blade cutting edges a predetermined normal distance apart;

the comb guard comprising a plurality of arcuately shaped teeth projecting substantially normally to planes bisecting the cutting edges of the first and second razor blades, the teeth being joined by a transversely extending member parallel to the forward margin forming substantially planar webs between respective teeth, the webs located in a plane having a selected angle with respect to the bisecting planes of the blade cutting edges, the teeth projecting at least approximately 0.020 inch above the webs and having a pitch between approximately 0.050 and 0.125 inch and a width between approximately 0.020 and 0.062 inch, the maximum width of the teeth selected to be less than approximately one-half the pitch; and wherein the first and second blade cutting edges have tangent angles between approximately 23 degrees and 27 degrees, the first blade cutting edge has a negative exposure between approximately 0.001 and 0.005 inch and a span between approximately 0.040 and 0.065 inch, and the second blade cutting edge has a negative exposure between approximately 0.004 and 0.008 inch and a span between approximately 0.040 and 0.065 inch.

2. The cartridge of claim 1 wherein the means for maintaining the cutting edges a predetermined distance apart comprises the first blade being bent along a first transverse parallel line, forming a ramp portion thereon at an angle away from the second blade and being bent along a second transverse parallel line forward of the first line so as to cause the cutting edge to be coplanar with the second blade cutting edge and spaced the predetermined distance therefrom.

3. The cartridge of claim 2 wherein the ramp portion is bent at an angle of 30 degrees from the plane of the second blade.

4. The cartridge of claim 3 wherein the seat member has a plurality of channels orthogonally arrayed with respect to the forward margin across the planar surface and the first blade ramp portion has a plurality of apertures therein in respective registration with the channels thereby providing for removal of shaving debris from the cartridge.

5. The cartridge of claim 1 wherein the first blade cutting edge has a tangent angle of approximately 23.6 degrees, a negative exposure of approximately 0.003 inch and a span of approximately 0.060 inch; and the second blade cutting edge has a tangent angle of approximately 24 degrees, a negative exposure of approximately 0.006 inch and a span of approximately 0.060 inch.

6. The cartridge of claim 5 wherein the transversely extending member forming substantially planar webs between respective teeth is a substantially cylindrical member and the webs thereby formed are substantially parallel to the bisecting planes of the blade edges, the teeth project approximately 0.041 inch, the pitch is approximately 0.100 inch and the width is approximately 0.040 inch.

7. The cartridge of claim 6 wherein the first blade web tangent angle is approximately 32 degrees and the second blade web tangent angle is approximately 29 degrees, the radius of curvature of the teeth has a mean value of approximately 0.075 inch and the teeth smoothly transition into the cylindrical portion of the guard having substantially the same radius of curvature.

8. The cartridge of claim 7 wherein the guard has an extreme margin extending approximately 0.100 inch from the first blade cutting edge, and the teeth and cylindrical member are spaced forwardly of the front margin of the seat member and joined thereto by a plurality of strut members extending substantially parallel to the bisecting plane of the blade and by abutment members located at either extreme of the seat member, which abutment members mask corner portions of the blades.

9. The cartridge of claim 1 wherein the means for spacing the blades comprises members depending vertically inwardly of the cap and seat members, the cap depending members in registration with complementary apertures in the second blade and having bearing surfaces in contact with the first blade, the seat depending members in registration with complementary apertures in the first blade and having bearing surfaces in contact with the second blade thereby respectively clamping the first and second blades in desired position when the cap member is affixed to the seat member.

10. The cartridge of claim 9 wherein the depending members are posts extending normally from the bearing surface of the cap member and the planar surface of the seat member and wherein there are a plurality of posts alternately spaced along the transverse length of the cartridge.

11. The cartridge of claim 10 wherein the posts have a plurality of varying diameters thereon having relatively selected dimensions so as to bear against respective apertures in the first and second blades thereby positioning the first and second blades in the cartridge.

12. The cartridge of claim 1 wherein the means for spacing the cutting edges is a spacer means supporting the blades substantially along their entire length.

13. A razor blade cartridge comprising:

a seat member;

a plurality of razor blades including a first blade disposed on a planar surface of the seat member having a cutting edge parallel to a forward margin of the seat member and a second blade in juxtaposition to the first blade having its cutting edge rearwardly located and parallel to the first blade cutting edge, the first blade being bent along a first transverse line parallel to its cutting edge at an angle of approximately 30 degrees to form a ramp portion at an angle away from the plane of the second blade and being inversely bent along a second transverse line parallel to and forwardly of the first line so that its cutting edge is parallel with the plane of the second blade, the ramp portion having a plurality of apertures therein;

a cap member having a bearing surface in contact with at least one of the blades and affixed to the seat member for clamping the blades in desired positions; and a guard member extending transversely of and parallel to the forward margin of the seat member and forwardly of the blade cutting edges.

14. A razor blade cartridge comprising:

a seat member;

a plurality of razor blades welded together in juxtaposition disposed on a planar surface of the seat member having a cutting edge parallel to a forward margin of the seat member and another cutting edge rearwardly located and parallel to the cutting edge;

one of the razor blades being bent along a first transverse line parallel to its cutting edge forming a ramp portion at an angle away from the plane of the other razor blade, and inversely bent along a second transverse line parallel to and forwardly of the first line thereby causing its cutting edge to lie in a plane at a selected angle to the plane of the other blade, the ramp portion having a plurality of apertures therein;

a cap member having a bearing surface in contact with at least one of the blades and affixed to the seat member for clamping the blades in desired position; and a guard member extending transversely of and parallel to the forward margin of the seat member and forwardly of the blade cutting edges.

* * * * *